US006360372B2

(12) United States Patent
Oster

(10) Patent No.: US 6,360,372 B2
(45) Date of Patent: Mar. 26, 2002

(54) SHIRT WITH ADJUSTABLE SLEEVES

(76) Inventor: Joseph Oster, 2611 W. Greenleaf St., Allentown, PA (US) 18104-3830

( * ) Notice: Subject to any disclaimer, the term of this patent is extended or adjusted under 35 U.S.C. 154(b) by 0 days.

(21) Appl. No.: 09/734,139

(22) Filed: Dec. 11, 2000

Related U.S. Application Data

(63) Continuation-in-part of application No. 09/596,435, filed on Jun. 19, 2000, now abandoned.

(51) Int. Cl.[7] ..... A41B 1/00
(52) U.S. Cl. ..... 2/126; 2/125; 2/269
(58) Field of Search ..... 2/125, 126, 69, 2/80, 83, 75, 269, 105, 106, 114, 115

(56) References Cited

U.S. PATENT DOCUMENTS

| | | | | |
|---|---|---|---|---|
| 497,727 A | | 5/1893 | Prentiss | |
| 1,066,713 A | | 7/1913 | Cronin | |
| 1,085,399 A | | 1/1914 | Bauer | |
| 1,147,155 A | | 7/1915 | Farlow | |
| 1,951,437 A | | 3/1934 | Parfitt | |
| 2,104,826 A | | 1/1938 | Stramiello | |
| 2,714,718 A | * | 8/1955 | Kramer | 2/75 |
| 2,725,565 A | * | 12/1955 | Wyner | 2/83 |
| 3,002,193 A | * | 10/1961 | Briskman | 2/80 |
| 3,064,265 A | * | 11/1962 | Bridgewaters | 2/75 |

* cited by examiner

*Primary Examiner*—Gloria M. Hale
(74) *Attorney, Agent, or Firm*—Drinker Biddle & Leath LLP

(57) ABSTRACT

The present invention relates to a shirt which has a lower adjustable sleeve segment that is capable of being removably attached to an upper fixed segment. The shirt includes first and second indexing mechanisms which, when aligned, provide desired circumferential orientation of the lower section with respect to the upper section. The indexing mechanism may embody patches affixed to the upper and lower segments. The indexing mechanism may also be incorporated into the attachment mechanisms, such as distinctly colored buttons or distinctly colored thread which secure the buttons or form the button holes.

19 Claims, 3 Drawing Sheets

SHIRT WITH ADJUSTABLE SLEEVES

CROSS REFERENCE TO RELATED APPLICATION

This is a continuation-in-part application of co-pending application Ser. No. 09/596,435, filed Jun. 19, 2000 now abandoned.

FIELD OF THE INVENTION

The present invention relates to a garment and, more particularly, to a shirt which includes adjustable sleeves that can be easily attached and detached by the user for changing the length of the sleeves.

BACKGROUND OF THE INVENTION

Generally speaking, shirts, and in particular dress shirts, have not varied much over the years. While some changes have been made with respect to features of shirts, for example, the type of collar, and the type of material from which the shirt is made, the general construction of the shirt has not been altered much.

All sleeved shirts include some form of a collar, front and back panels and sleeves. Typically a person possesses two different types of shirts to accommodate their needs for different situations, such as different temperature environments. For example, with respect to dress shirts, it is quite common to have both long sleeves (i.e., sleeves which reach from the shoulder down to the wrist), as well as short sleeves (i.e., sleeves which reach from the shoulder down to approximately the elbow). In a warm environment, the user would tend to wear a short sleeve shirt, whereas in a cold environment, the user instead wears a long sleeve shirt.

In modern day business environments, it is quite common for businesspeople, during the course of the day, to need to have two different types of shirts available. For example, the businessperson might be dressed up for the business environment, then at some point during the day need to "dress down" for a certain situation (e.g., going to a casual meeting after work, or a business location which requires, or where it is beneficial to wear, a short sleeve shirt). In such circumstances, the businessperson would need to have two different types of shirts available, one long sleeve shirt and one short sleeve shirt.

Also, if the temperature in a person's home or office changes significantly during the course of the day (e.g., because of loss of air conditioning and/or heating), it may be necessary for the person to change their attire to account for this change in temperature. If the person happens to be wearing a long sleeve dress shirt, they may need to roll-up the sleeves to provide the necessary cooling. However, in some business environments, this type of appearance is not preferred or may be considered "sloppy".

A typical dress shirt includes cuffs at the ends of the sleeves having buttons located on the outside of a wearer's arm. Therefore it is desirable that the adjustable sleeves be oriented with respect to the shirt to present buttons on the outside of a wearer's arm in accordance with the established custom. To date, no existing outerwear permits removable sleeves to be indexed for proper alignment.

A need, therefore, exists for an improved shirt which allows for variations in sleeve length to account for different circumstances and provides a mechanism for permitting the removable sleeve to be attached in the proper orientation.

SUMMARY OF THE INVENTION

The present invention relates to a shirt which has a lower adjustable sleeve segment that is capable of being removably attached to an upper fixed segment in more than one circumferential orientation. The shirt includes first and second indexing mechanisms supported by the upper and lower segments providing for attachment of the lower segment in a particular desired circumferential orientation.

The indexing mechanisms according to the present invention may embody patches affixed to the upper and lower sleeve segments such that alignment of the patches results in the desired circumferential orientation. The first and second indexing mechanisms may also be incorporated into the attachment mechanisms providing for the releasable attachment of the lower segment to the upper segment. According to one embodiment the first indexing mechanisms include distinctly colored buttons or button securing thread while the second indexing mechanism includes distinctly colored thread reinforcing the button hole to be engaged by the button bearing the first indexing mechanism.

The indexing mechanism may also embody hook and loop material of a hook and loop connector in which the first indexing mechanism includes a distinctly colored portion of loop material which is secured to the upper segment and the second indexing mechanism includes a distinctly colored portion of hook material secured to the lower segment. Attachment of the distinctly colored portion of loop material to the distinctly colored portion of the hook material provides for the desired circumferential orientation of the lower sleeve segment.

The use of a removable segment permits the sleeve to be shortened to address changes in temperature or social environments. The use of indexing mechanisms facilitates attachment of the removable segment in a particular circumferential orientation which is useful for presenting cuff buttons according to established custom on the outside of a wearer's arm.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE INVENTION

While the invention will be described in connection with one or more preferred embodiments, it will be understood that it is not intended to limit the invention to those embodiments. On the contrary, it is intended that the invention cover all alternatives, modifications and equivalents as may be included within its spirit and scope as defined by the appended claims.

Figure 1:
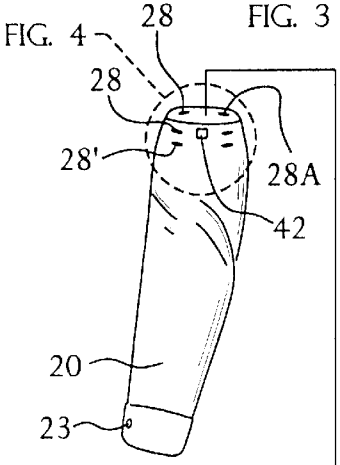
FIG. 1 is a front view of a shirt according to the present invention illustrating a lower removable sleeve segment attached to a upper fixed sleeve segment.
Figure 1:
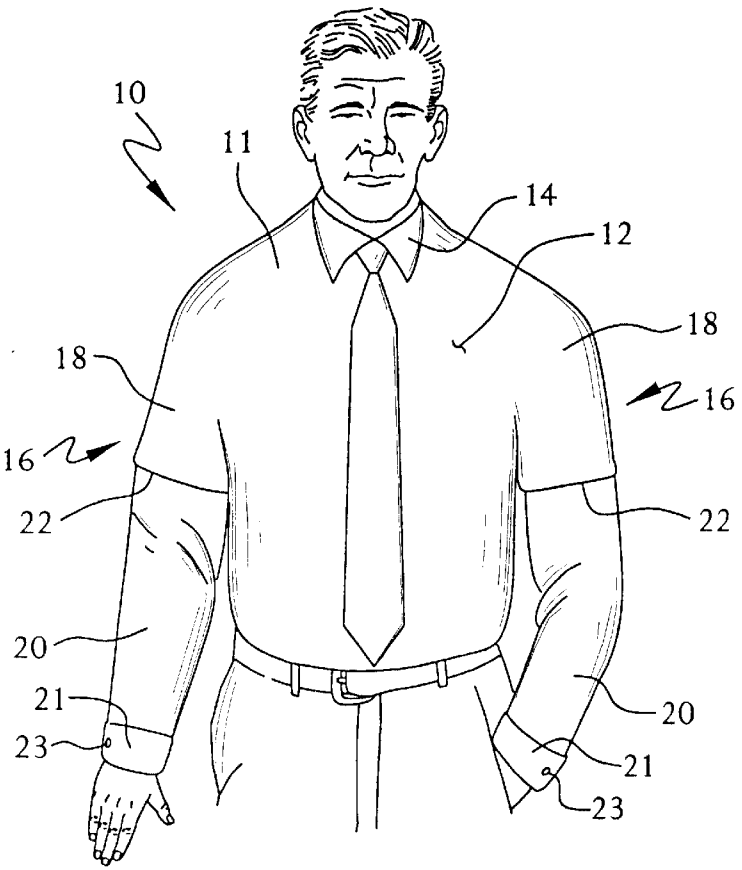

Referring now to FIG. 1, a shirt 10 is shown, which in the preferred embodiment is in the form of a business dress shirt such as one typically worn by a businessperson. The shirt 10 includes a body portion 11 having a front panel 12 which may or may not include buttons, a back panel (not shown), a collar 14, and two sleeves 16 located on the sides of the body portion 11 and attached to both the front and back panels. The sleeves 16 include an upper fixed segment 18 and a lower removable segment 20. The upper fixed segment 18 extends from a shoulder of the shirt 10 to an intermediate end 22. The lower removable segment 20 of the sleeve 16 is removably attached to the upper fixed segment 18 near the intermediate end 22, and extends down to a cuff portion 21 of the sleeve having a cuff button 23. As shown, it is conventional that the shirt be configured such that the cuff buttons 23 are presented on the outside of a wearer's arms.

Figure 2:
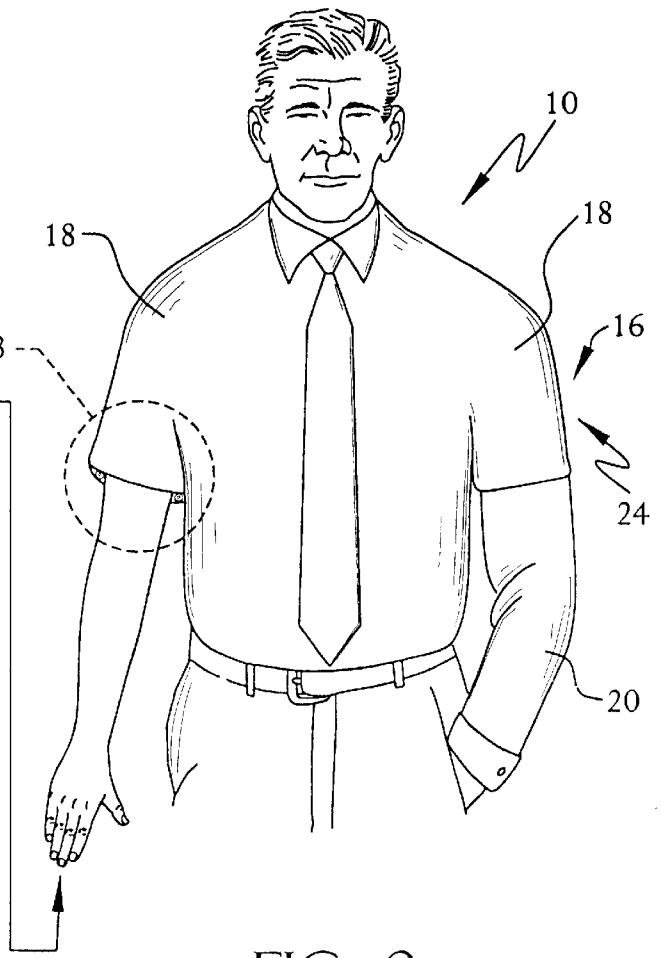
FIG. 2 is a front view of a shirt according to the present invention illustrating the lower removable sleeve segment detached from the upper fixed sleeve segment.
Figure 3:
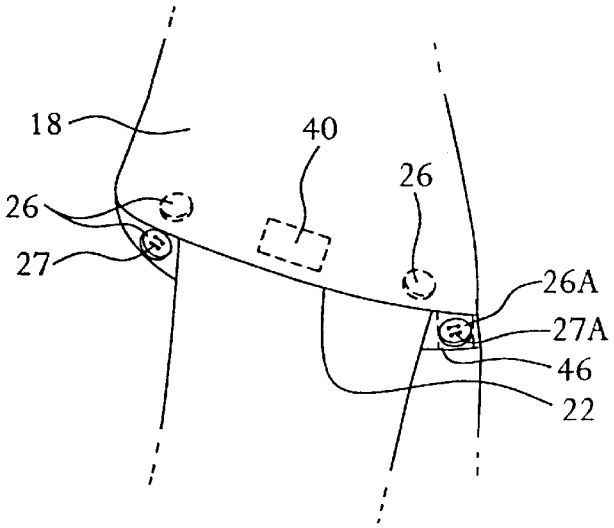
FIG. 3 is an enlarged view from FIG. 2 showing the lower portion of the upper fixed sleeve segment.
Figure 4:
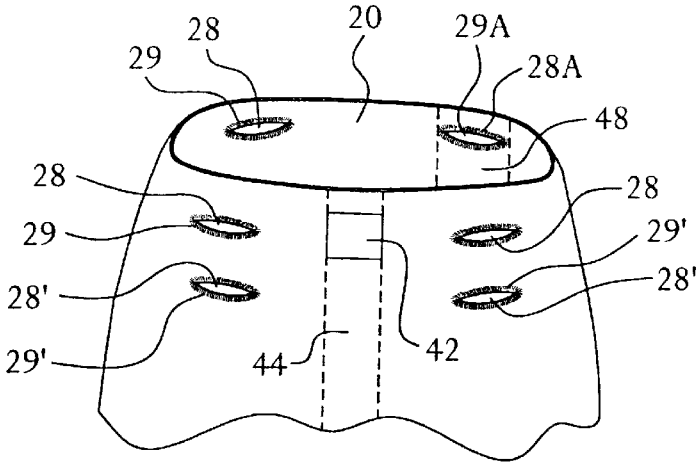
FIG. 4 is an enlarged view from FIG. 2 showing the upper portion of the lower removable sleeve segment.

Referring now to FIGS. 2–4, each of the upper fixed segment 18 and the lower removable segment 20 includes an end portion defining a loop having a circumference. The lower removable segment 20 is removably attached to the upper fixed segment 18 with the use of a removable attachment device 24. In a preferred embodiment, the lower removable segment 20 of the sleeve 16 is attached to the upper fixed segment 18 via a set of buttons 26, 26A secured to an end portion of the lower removable segment 20 adjacent a terminal edge of the upper fixed segment 18. More particularly, as best seen in FIG. 3, the set of buttons most preferably includes four buttons 26, 26A which are sewn onto the inside of the end portion of the upper fixed segment 18 of the sleeve by lengths of thread 27 and 27A. As will be described in greater detail, the button 26A is distinct from the buttons 26 and/or the length of thread 27A is distinct from the length of threads 27 in order to facilitate attachment of the lower removable segment 20 in a particular circumferential orientation. The buttons 26, 26A are preferably attached to the upper fixed segment of the sleeve at four spaced locations, preferably evenly spaced around the circumference from one another.

The buttons 26, 26A are designed to engage with a set of four button holes 28, 28A, best seen in FIG. 4, formed on the end portion of the lower removable segment 20 of the sleeve 16. As will be described, button hole 28A is distinctive from other button holes of the set of four. The set of button holes 28, 28A are located at a distance from a terminal edge of the end portion of the lower removable segment 20. Each of the button holes 28, 28A is preferably equidistant from the terminal edge with respect to the others. The button holes 28, 28A are also equally spaced about the circumference of the end portion of lower removable segment 20 thereby providing for engagement of the buttons 26, 26A of the upper segment 18 with the button holes 28, 28A.

In order to provide for adjustability of the lower removable segment 20 of the sleeve 16, additional sets of button holes, such as button holes 28', can be formed at one or more different axial distances from the terminal edge of the lower removable segment 20. For example, if the second set of button holes 28' are spaced one inch in the axial direction from the first set of button holes 28 (i.e., one inch further from the edge), the length of the sleeve can be adjusted by one inch by attaching the buttons 26 to the second set of button holes 28'. It is to be understood that buttons of the additional sets aligned with button hole 28A with respect to the circumference of the lower segment 20, not seen in the FIGS. 2 and 4, could be made to be distinct from other button holes of a particular set of buttonholes, in the manner to be described.

While four buttons are used to attach the upper fixed segment 18 to the lower removable segment 20 in the preferred embodiment, it should be understood that only a plurality of buttons is required to secure the two parts together.

Figure 5:
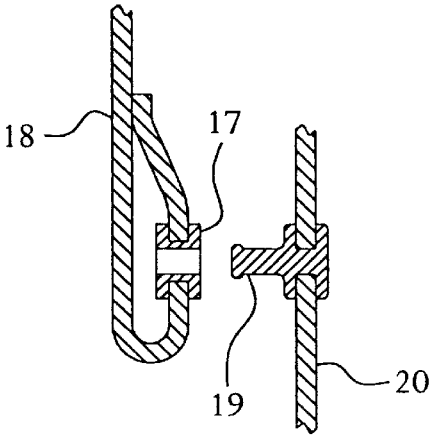
FIG. 5 is a view illustrating a snap-type connector for removably securing the lower removable sleeve segment to the upper fixed sleeve segment.

In an alternate embodiment, the lower removable segment 20 of the sleeve is attached to the upper fixed segment 18 through a snap-type attachment, per se well known in the art. An example of a snap-type attachment is shown in FIG. 5 to include a female component 17 of the snap, i.e., the portion that includes a receptacle. The female component 17 is supported on the upper fixed segment 18 of the sleeve for engagement with a male component 19 of the attachment, i.e., the portion with the protruding element, supported on the lower removable segment 20 of the sleeve. It is preferred that the female component is located on the upper fixed segment 18 to prevent or minimize irritation of the user's arm which may occur if the male component with the protruding element were located on the upper fixed segment 18. The snap can be located on an inner fold of a cuff formed on the end portion of upper fixed segment 18 so that the snap does not show. Two or more, and most preferably four, snap-type fasteners would be used to attach the lower removable segment 20 to the upper fixed segment 18.

Figure 6:
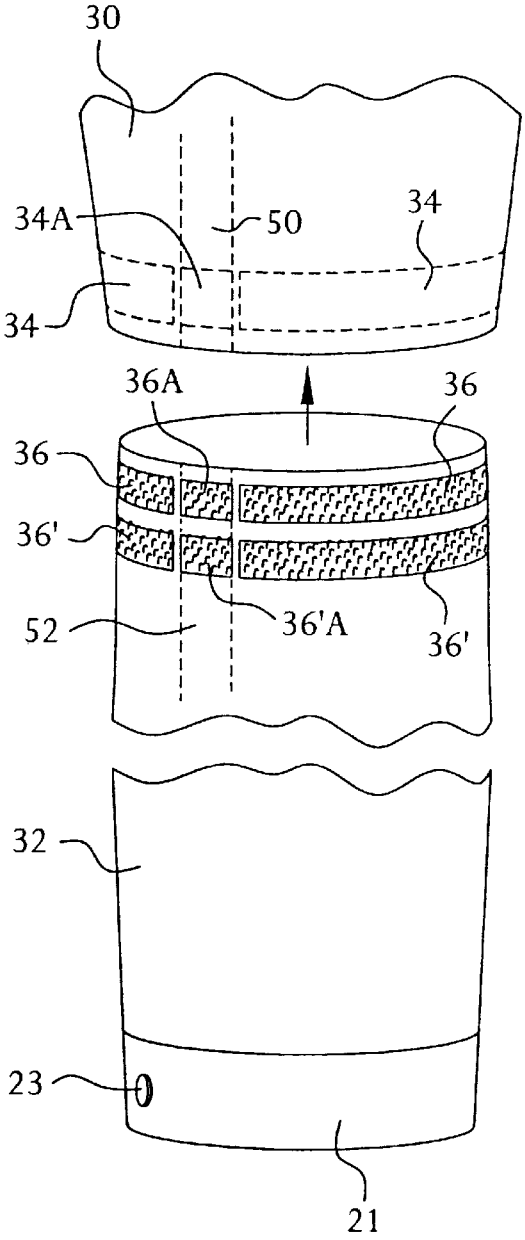
FIG. 6 is a partial perspective view of a shirt having hook and loop material securing upper and lower sleeve segments and incorporating indexing mechanisms according to the present invention.
Figure 7:
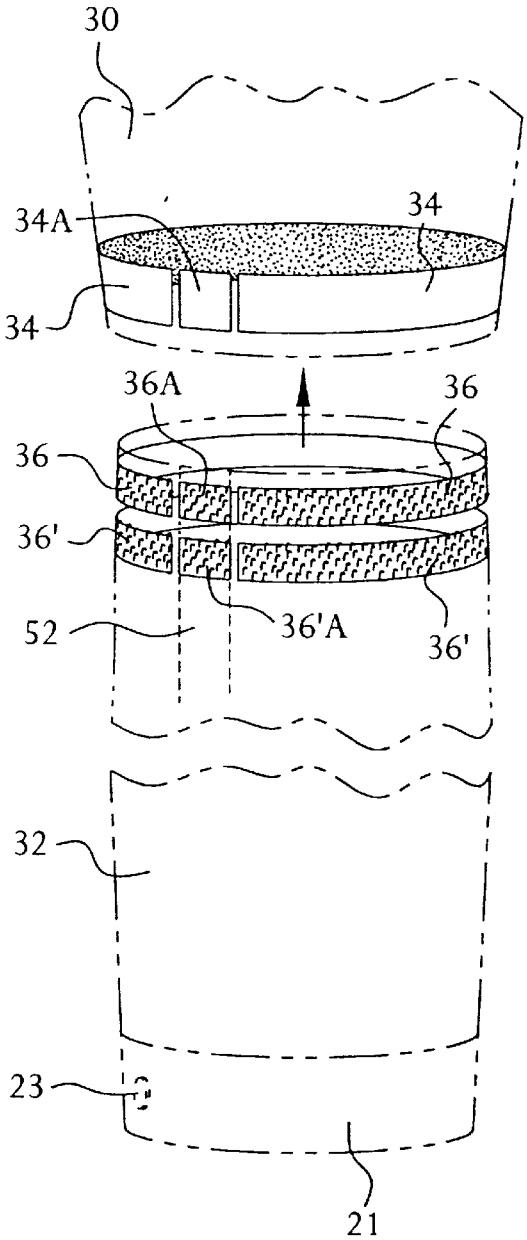
FIG. 7 is a partial perspective similar to FIG. 6 with the shirt shown in phantom for clarity of view.

Turning to FIG. 6 it is also contemplated that a hook and loop type of fastener can be used to attach a lower removable segment 30 to an upper fixed the upper fixed segment 32 according to the present invention. This type of fastener is well known in the art and is available from Velcro USA Inc. of Manchester, Ohio under the registered trademark Velcro®. In this embodiment, the hook portion of the fastener is located on one segment of the sleeve and the loop component is located on the other segment. Preferably, to avoid irritating the user's arm, the loop material of the fastener is located on the upper fixed segment 30 of the sleeve and the hook material is located on the lower removable segment 32. The end portion of the upper portion 30 is shown in phantom in FIG. 7 for clarity in viewing of the loop material which is secured to the inside of the upper portion 30. In the embodiment shown, loop material includes a portion 34 which extends around a majority of the circumference of the upper segment. The loop material also includes a portion 34A located between terminal ends of the segment 34 resulting in loop material extending substantially around the entire circumference of the upper segment 30. As will be described, the portion 34A is distinct from the portion 34 to facilitate attachment of the lower removable segment 32 in a particular circumferential orientation with respect to the upper segment 30. Portion 34 could equally be sub-divided into a series of smaller spaced-apart sections with one section being distinct from the rest. It is not required that loop material be provided over the entire circumference.

Hook material is provided on the lower segment 32 for removable attachment to the loop material of the upper segment 30. As shown, it is preferred that hook material be located on the lower segment 32 at two distances from the terminal edge. Accordingly, the preferred embodiment includes portions 36, 36A of hook material formed on the lower removable segment at a first distance from the terminal edge and portions 36', 36A' formed on the lower removable segment at a second distance. In a similar fashion to the multiple sets of button holes shown in FIGS. 2 and 4A for sleeve segments 18, 20, the inclusion of hook material located at different distances from a terminal edge of lower segment 32 provides for axial adjustability in the attachment of the lower segment 32 and accordingly adjustability in the length of the combined sleeve resulting from the attachment. The portions denoted 36A and 36'A are distinct from portions 36 and 36', respectively, in order to facilitate attachment of the lower segment 32 in a particular circumferential orientation with respect to the upper segment 30. While the hook material is shown as extending substantially completely around the circumference of the lower segment, it is also contemplated that the hook material could attached in spaced-apart sections.

In order to maintain an aesthetically pleasing appearance, it is desirable that the fastening take place underneath the upper fixed segment 18, 30 of the sleeve so as to hide the fastener from view. That is, the fastener is located on the inside of the upper fixed segment 18, 30, preferably spaced from the edge, and on the outside of the lower removable segment 20, 32. Thus, in order for the lower removable segment 20, 32 to attach to the upper fixed segment 18, 30, it must extend under the upper fixed segment 18, 30 such that the upper fixed segment 18, 30 overlaps the upper edge of the lower removable segment 20, 32. This is particularly advantageous in a dress shirt where the fastener on the sleeve would otherwise be showing, detracting from the business appearance of the shirt 10. Also, by hiding the fastener underneath the upper fixed segment 18, 30 the sleeve looks more natural in appearance.

Removable attachment of the lower removable segment of the sleeve is achieved by the user reaching underneath the upper fixed segment and unbuttoning each of the buttons (in the case of buttons), or unsnapping the snaps (in the case of snap attachments). To separate the sleeve segments having a hook and loop fastener, the user can simply pull the two sleeve segments apart to separate them.

A consequence associated with the removable attachment of a lower sleeve segment to an upper sleeve segment according to the present invention is the existence of a plurality of possible circumferential attachment orientations of the lower sleeve segment with respect to the upper sleeve segment. Specifically, in the button embodiment of FIGS. 2–4 and in the snap embodiment of FIG. 5, there are four possible circumferential orientations of attachment. With the hook and loop embodiment of FIG. 6 in which connector material is included around substantially the entire circumference of the upper and lower segments, there are a nearly infinite number of possible circumferential orientations of attachment. One drawback to the multiplicity of circumferential orientations of attachment associated with the present invention relates to the cuff button 23 included on the cuff portion 21. Because it is customary for the cuff button 23 to appear on the outside of the wearer's arm, the cuff button will appear in an improper location in the majority of possible attachment orientations for the button and snap embodiments, and in the vast majority of possible attachment orientations for the hook and loop embodiment. Thus, in order for a wearer to conform to custom, a selection process in required in which one correct orientation must be chosen from among the multiple possible orientations.

The present invention facilitates selection of the appropriate attachment orientation by inclusion of first and second indexing mechanisms supported by the upper and lower sleeve segments, respectively. The indexing mechanisms serve to distinguish a longitudinally extending portion of each of the upper and lower segments from remaining portions extending around the loops of the upper and lower segments on opposite sides of the longitudinally extending portions. Referring to FIGS. 3 and 4, an example of a first indexing mechanism 40 supported on the upper segment 18 is shown in phantom line to indicate its location on the inside of the loop defined by the end portion of the upper segment 18. A second indexing mechanism 42 is shown supported in a corresponding location of the lower segment 20 with respect to the circumference. In this embodiment the indexing mechanisms do not serve to attach the segments together, but instead serve to provide an orientation for the lower segment with respect to the upper segment. For example, the indexing mechanisms orient a longitudinal section (illustrated in dashed lines and identified by the numeral 44) with the first indexing mechanism 40. Thus, attachment of the lower segment 20 to the upper segment 18 utilizing the previously described buttons and button holes such that the indexing mechanisms 40 and 42 are aligned with one another results in the desired circumferential orientation of the lower segment 20 with respect to the upper segment 18.

The indexing members are preferably different in color from the upper and lower segments on which they are supported. The indexing members 40, 42 are preferably separate patches of material affixed to the upper and lower segments 18, 20 by sewing for example. However, it is contemplated that the indexing members could alternatively embody thread having a different color from the sleeve segments which is stitched to the sleeve segment, in a square shape for example. Although the preferred indexing mechanisms are shown as square in shape, this is not required by the present invention and indexing mechanisms could take any shape, so long as they have the ability of being distinguished from the sleeve segments on which they are supported.

Alternatively, the first and second indexing members may be incorporated into the attachment mechanisms providing the releasable attachment of the lower segment to the upper segment. Referring again to FIGS. 2–4, the set of buttons 26, 26A includes one button 26A which is configured to be distinct from all of the other buttons 26 of the set to function as the first indexing mechanism. Most preferably, the button 26A is colored differently than the other buttons 26 of the set to provide for immediate visual distinction and selection of the distinct button 26. Alternatively, the button 26A could be configured to be distinct from the other buttons 26 of the set by being formed to have differing dimension or shape or having a different surface texture or finish for visual and/or tactile distinction. It is also possible to incorporate the first indexing mechanism into the thread securing the button 26A to distinguish the button from the other buttons. Thus, instead of button 26A being different in color, the length of thread 27A securing button 26A could be configured to be distinct from the lengths of thread 27 securing the other buttons 26 of the set of buttons. Most preferably, distinction would be provided through the use of a different color for the length of thread 27A than the color of the other lengths of thread 27 associated with the set of buttons. The longitudinally extending portion of the upper sleeve distinguished by the first indexing mechanism of button 26A is identified as 46 in FIG. 3 bounded by imaginary lines shown by dashed lines.

As seen in FIG. 4, it its typical for button holes to be reinforced by thread, identified as 29, 29A for the first set of buttons, and 29' and 29A' (not shown) for the second set of buttons. The thread is tightly stitched to the material surrounding the button hole. This provides a useful location for incorporation of the second indexing mechanism on the lower segment 20 according to the present invention.

Accordingly, button hole 28A of the set of button holes is reinforced by thread 29A which is distinct from thread 29 provided for button holes 28. Most preferably, the reinforcing thread 29A stitched around button hole 28A is different in color from the reinforcing thread 29 which is stitched around button holes 28. The reinforcing thread 29A therefore serves to distinguish a longitudinally extending portion of the lower segment 20, identified as 48 in FIG. 4 bounded by imaginary lines shown by dashed lines, which includes hole 26A. This serves to distinguish the longitudinally extending portion containing the thread 29A from a remaining portion of the lower segment 20 extending around the loop of the lower segment 20 from opposite sides of the longitudinally extending portion. Securement of button 26A in button hole 28A results in the desired circumferential orientation of the lower segment 20 with respect to the upper segment 18. Although it not required, the button hole of the second set of button holes 28' which is located in the longitudinally extending portion 48 of the lower segment 20 already distinguished by reinforcing thread 29A of button hole 28A could also be reinforced by thread which is distinct from the thread reinforcing the remaining button holes 28'.

Turning to FIG. 6, there is illustrated first and second indexing mechanisms incorporated in the hook and loop material secured to the first and second segments, 30, 32 respectively. The portion of loop material 34A is configured to be distinct from portion 34 of loop material to function as the first indexing mechanism. Most preferably the portion 34A is different in color than the portion 34. Alternatively, the loop material of portion 34A could be configured to present a surface texture which is distinct in appearance from a surface texture presented by portion 34. The longitudinally extending portion of the upper sleeve 30 is identified as 50.

In a similar fashion, the portion 36A of hook material secured to the lower segment 32 is configured to be distinct from portion 36 of hook material to function as the second indexing mechanism. Most preferably, the portion 36A is different in color from the portion 36. The longitudinally extending portion distinguished by portion 36A is identified as 52. Attachment of lower segment 32 to upper segment 30 such that portion 34A of loop material overlies and engages with portion 36A of hook material results in the desired circumferential orientation of the lower segment 32 with respect to the upper segment 30. Portion 36'A could be configured to be distinct from portion 36' in addition to, or instead, of the previously described distinct configuration for portion 36A. Distinctly configuring either of portions 36A or 36'A from portions 36 or 36', respectively, serves to distinguish a longitudinally extending portion of the lower segment 32 which includes both of the portions 36A, 36'A.

The present invention provides a novel shirt with the capability of adjusting the length of the sleeves, completely removing the sleeves, or varying the type of sleeve that is attached (e.g., french cuff, straight cuff, different color, etc.) This last feature is particularly important to young individuals, such as teenagers, who like to vary their appearance or otherwise distinguish themselves. The present invention allows them to include sleeves that are of a different color or pattern from the rest of the shirt.

While the present invention has been described with respect to a dress shirt, it is also contemplated that the present invention may be used in a non-dress, conventional crew-type shirt. In such a shirt, the upper fixed segment would attach to a lower removable segment in a similar manner as described above. It is also contemplated that the present invention can be used on jackets, such as safari jackets.

What is claimed is:

1. A shirt comprising:

a body portion having opposite sides;

a pair of sleeves each having an upper segment secured to one of the sides of the body and a lower segment removably attached at an end portion to an end portion of the upper segment, each of the end portions defining a loop having a circumference, the end portions capable of being attached in a plurality of circumferential orientations;

indexing mechanisms for identifying a particular circumferential orientation between the upper and lower segments of each of the sleeves, the indexing mechanisms including at least one first indexing mechanism on the end portion of each of the upper segments and adapted to identify a specific location on the upper segment, at least one second indexing mechanism on the end portion the lower segment and adapted to identify a specific location on the lower segment, the upper and lower segments of each sleeve being attachable such that alignment of the first and second indexing mechanisms provides proper orientation of the lower segment with respect to the upper segment.

2. The shirt according to claim 1 wherein the first indexing mechanism is a patch affixed to the upper segment and wherein the second indexing mechanism is a patch affixed to the lower segment.

3. The shirt according to claim 1 wherein the lower segment of each sleeve includes at least one set of a plurality of holes and a hole reinforcing member adjacent each of the holes, the holes of each set of holes being equidistant from a terminal edge of the lower segment, the upper segment including at least one set of a plurality of buttons and a length of thread securing each of the buttons to the upper segment, the buttons being spaced equidistant from a terminal edge of the upper segment, and wherein one of the hole reinforcing members of each set of hole reinforcing members is distinct from the others of the set of hole reinforcing members thereby forming the second indexing mechanisms, and wherein one of either the buttons or the lengths of thread is distinct from the other buttons or lengths of thread thereby forming the first indexing mechanisms.

4. The shirt according to claim 3 wherein the hole reinforcing members comprise thread and wherein the thread of the one of the hole reinforcing members of each set is distinct in color from the thread of the others of the set of hole reinforcing members.

5. The shirt according to claim 3 wherein the first indexing mechanism is one length of thread for each set of buttons, the length of thread being distinct in color from the other lengths of thread for the set of buttons.

6. The shirt according to claim 3 wherein the first indexing mechanism is a button that is distinct in color from the other buttons of the set of buttons.

7. The shirt according to claim 3 wherein the lower segment includes at least two sets of holes and wherein the upper segment includes one set of buttons.

8. The shirt according to claim 1 wherein the lower segment of each sleeve includes hook material of a hook and loop connector, the hook material located at a prescribed distance from a terminal edge of the lower segment, wherein the second indexing mechanism comprises a portion of the hook material being distinct from the remainder of the hook material, and wherein the upper segment includes loop material, the loop material located at a prescribed distance from a terminal edge of the upper segment, wherein the first indexing mechanism comprises a portion of the loop material being distinct from the remainder of the loop material.

9. The shirt according to claim 8 wherein the lower segment includes a plurality of sections of hook material, the sections being axially spaced apart from one another.

10. The shirt according to claim 9 wherein the sections are spaced axially along the length of the lower segment.

11. The shirt according to claim 9 wherein the second indexing mechanism comprises one section of the hook material being distinct in color from the remaining sections of hook material.

12. An apparatus for circumferentially indexing a removably attachable segment of a garment to a fixed segment of the garment, each of the segments having an end portion defining a loop having a circumference, the apparatus comprising:

at least one first indexing mechanism supported by the end portion of the fixed segment, the at least one first indexing mechanism located at a prescribed location on the fixed segment;

at least one second indexing mechanism supported by the end portion of the removably attachable segment, the at least one second indexing mechanism located at a prescribed location on the removably attachable segment, the alignment of the first and second indexing mechanisms adapted to circumferentially orient the removably attachable segment with respect to the fixed segment.

13. A shirt comprising a front panel;

a back panel;

two sleeves located on the sides of the shirt, each sleeve including an upper fixed portion which attaches to the front and back panels of the shirt, and a lower removable portion of the sleeve, the lower portion being removably attached to the upper portion;

a first indexing mechanism located on the upper portion and adapted to identify a specific location on the upper portion; and a second indexing mechanism on the lower portion and adapted to identify a specific location on the lower portion, wherein the attachment of the upper and lower portions of each sleeve such the first and second indexing mechanisms are aligned provides proper circumferential orientation of the lower portion with respect to the upper portion.

14. A shirt according to claim 13 wherein the removable attachment is provided by a plurality of buttons located on an inside of the upper fixed portion of the sleeve, the plurality of buttons removably engaging with button holes formed on the lower portion of the sleeve, and wherein the first indexing mechanism comprises one button that is identifiably different from the other buttons.

15. A shirt according to claim 14 wherein there are two sets of button holes formed in the lower portion of the sleeve, the first set of button holes being located at a first axial location on the sleeve, and the second set of button holes being located at a second axial location on the sleeve, the button holes being spaced about the periphery of the sleeve so as to define first and second attachment locations for engagement by the buttons, the two attachment locations allowing the length of the sleeve to be adjusted, and wherein the second indexing mechanism comprises one button hole in each set that is identifiably different from the other button holes in the set.

16. A shirt according to claim 13 wherein the attachment mechanism is a plurality of snaps located at spaced-apart positions around the circumference of the sleeve portions, each snap including a female component and a male component, the female components being located on one of either the upper or lower portion of the sleeve and the male components being located on the other portion of the sleeve, and wherein the first indexing mechanism comprises one female component that is identifiably different from the other female components, and wherein the second indexing mechanism comprises one male component that is identifiably different from the other male components.

17. A shirt according to claim 16 wherein the female component is attached to a cuff formed on the upper fixed portion of the sleeve such that the snap is located on an inner fold of the cuff so as to not be viewable from outside the sleeve.

18. A shirt according to claim 13 wherein the removable attachment is a hook and loop type fastener, the hook component of the fastener being located on the removable portion of the sleeve and the loop component of the fastener being located on the fixed portion of the sleeve.

19. A shirt according to claim 18 wherein there are a plurality of sections of hook components spaced about the circumference of the removable portion of the sleeve, and a plurality of sections of loop components spaced about the circumference of the fixed portion of the sleeve, wherein the first indexing mechanism comprises one of the sections of hook components being identifiably distinct from the other sections of the hook component, wherein the second indexing mechanism comprises one of the sections of loop components being identifiably distinct from the other sections of the loop components.

* * * * *